US006913551B1

(12) United States Patent
Foley

(10) Patent No.: US 6,913,551 B1
(45) Date of Patent: Jul. 5, 2005

(54) BASKETBALL TRAINING AID

(76) Inventor: Sam Foley, P.O. Box 244, Zionsville, IN (US) 46077

( * ) Notice: Subject to any disclaimer, the term of this patent is extended or adjusted under 35 U.S.C. 154(b) by 0 days.

(21) Appl. No.: 10/351,209

(22) Filed: Jan. 24, 2003

Related U.S. Application Data

(63) Continuation-in-part of application No. 09/793,672, filed on Feb. 26, 2001, now abandoned.

(51) Int. Cl.[7] ..... A63B 69/00; A63B 63/08; A45D 42/14

(52) U.S. Cl. ..... 473/448; 473/488; 473/481; 248/206.2

(58) Field of Search ..... 248/206.2, 206.3, 248/206.4; 473/422, 426, 434, 435, 446, 447, 448, 449, 468, 476, 470–472, 478–489; 273/317, 317.3, DIG. 25, 348, 348.2, 407, 402

(56) References Cited

U.S. PATENT DOCUMENTS

| | | | | |
|---|---|---|---|---|
| 2,911,758 | A | | 11/1959 | Carson |
| 2,918,283 | A | | 12/1959 | Marschalk |
| 3,342,486 | A | | 9/1967 | Farley |
| 3,752,477 | A | | 8/1973 | Hoyt |
| 4,109,910 | A | | 8/1978 | Gleason |
| 4,206,915 | A | | 6/1980 | Woodcock |
| 4,213,606 | A | | 7/1980 | Wilson |
| 4,226,416 | A | | 10/1980 | Callanan |
| 4,828,303 | A | * | 5/1989 | Soria ..... 293/128 |
| 5,195,742 | A | | 3/1993 | Bailey |
| 5,207,789 | A | | 5/1993 | Gates |
| 5,308,059 | A | | 5/1994 | Owen, Jr. et al. |
| 5,364,092 | A | | 11/1994 | Riepe et al. |
| 5,381,990 | A | | 1/1995 | Belokin et al. |
| 5,433,095 | A | | 7/1995 | Mitchell et al. |
| 5,480,140 | A | | 1/1996 | Darnell |
| 5,665,016 | A | | 9/1997 | Burnett |
| 5,803,837 | A | | 9/1998 | LoFaso, Sr. |
| 5,823,896 | A | | 10/1998 | Pearsall |
| 5,827,136 | A | | 10/1998 | Halter et al. |
| 5,833,556 | A | | 11/1998 | Ferrari |
| 5,910,058 | A | | 6/1999 | Zheng |

OTHER PUBLICATIONS

Shoot–A–Way Advertisement Web Page http://shoot–a–way.com/basketball_equipment/Commercial/shoot–a–way–commercial.htm.
Arcaide Advertisement Web Page http://arcaide.com/technical.htm?cart=01A15pla.rut.
Basketball Shooting Aids Magazine Advertisement.

* cited by examiner

*Primary Examiner*—Mitra Aryanpour
(74) *Attorney, Agent, or Firm*—C. John Brannon; Daniel L. Boots; Bingham McHale LLP

(57) ABSTRACT

An improved basketball training aid comprising a barrier over which a basketball shot must be lofted in order to pass through the basketball goal. The basketball training aid is intended for attachment to a basketball backboard and basketball goal. The basketball training aid comprises a shield formed into a substantially semi-circular shape or a substantially semi-elliptical shape with a gripping means affixed to each end of the shield. In use, each of the gripping means is attached to the front surface of the basketball backboard. The shield is held in place by the gripping means slightly above and substantially parallel to the basketball goal solely by the gripping means, with the upper surface of the shield is positioned above the top surface of the basketball goal and outside the front edge of the basketball goal. The basketball training aid is removed from the front surface of the basketball backboard by detaching each gripping means from the front surface of the basketball backboard.

14 Claims, 7 Drawing Sheets

BASKETBALL TRAINING AID

CROSS-REFERENCE TO RELATED APPLICATIONS

This application is a continuation in part of pending U.S. patent application Ser. No. 09/793,672 filed Feb. 26, 2001, now abandoned, and claims priority thereto.

BACKGROUND

The game of basketball was invented by Dr. James Naismith in 1891 in Springfield, Mass. Although the peach basket basketball goals of Dr. Naismith's day have given way in modern times to basketball goals incorporating engineered breakaway rims, the objective of the game has not changed. Points are awarded by shooting a basketball through the basketball goal.

It is known in the art of basketball shooting that one using proper basketball shooting technique will successfully shoot a basketball through the basketball goal more frequently than one who does not. It also is known in the art of basketball shooting that a basketball approaching the basketball goal at a low or flat trajectory stands a smaller chance of passing successfully through the basketball goal than does a basketball approaching the basketball goal at a higher or more lofted trajectory. Thus, one component of proper basketball shooting technique is the ability to impart a properly lofted trajectory on the basketball.

Several attempts have been made to develop a basketball training device which, through repetitive use, will assist a basketball shooter in developing the muscle memory required to impart the desirable lofted trajectory on his or her basketball shots. One such device is disclosed in U.S. Pat. No. 5,833,566 to Ferrari. The Ferrari device involves placement of a vertically oriented circular member between the shooter and the basketball goal. The plane including the circular member is perpendicular to the plane including the basketball goal. The object of the Ferrari device is to shoot the basketball such that it passes first through the vertically oriented circular member, and then through the horizontally oriented basketball goal. The vertically oriented circular member is positioned along the shooter's desired trajectory.

While Ferrari's device may assist a basketball shooter in developing the desirable lofted trajectory on his or her basketball shots, it possesses several disadvantages. First, it is known in the art of basketball shooting that the shooter's attention should be directed toward the basketball goal as the shooter attempts the shot. By hand-eye coordination, a shooter whose attention is directed toward the basketball goal will determine the distance and direction of the basketball goal, and then release the basketball with the velocity and degree of inclination necessary to cause the basketball to reach the basketball goal. Because the Ferrari device provides an intermediate target for the shooter, its use may direct the shooter's attention away from basketball goal and onto the Ferrari device. Thus, when the device is removed, such as during competition, the shooter may become disoriented and unable to repeat the shooting technique he or she practiced. The Ferrari device also is disadvantageous in that it must be repositioned if the shooter wishes to practice shooting from a different position on the basketball court. Because the degree of inclination of a basketball shot may change based on the shooter's distance from the basketball goal, the height of the vertically oriented circular member of the Ferrari device also must be changed based on the shooter's distance from the basketball goal. In addition, because the Ferrari device must be positioned directly between the shooter and the basketball goal during use, it must be repositioned each time the shooter wishes to change the position on the basketball court from which he or she is practicing.

Another basketball training device is disclosed in U.S. Pat. No. 5,803,837 issued to LoFaso, Sr. The LoFaso, Sr. device comprises a circular or elliptical member that is mounted to or above the basketball goal. The plane including the circular or elliptical member forms an acute angle with respect to the plane including the basketball goal. The object of the LoFaso, Sr. device is to shoot the basketball such that it passes first through the acutely angled circular or elliptical member, and then through the horizontally oriented basketball goal. The acutely angled circular or elliptical member is positioned along the shooter's desired trajectory. Through repetitive use, such a basketball training device will assist a basketball shooter in developing the muscle memory required to impart the desirable lofted trajectory on his or her basketball shots.

The LoFaso, Sr. device possesses some of the same disadvantages of the Ferrari device. The LoFaso, Sr. device must be positioned directly between the shooter and the basketball goal during use, so it must be repositioned each time the shooter wishes to change positions on the basketball court from which he or she is practicing.

Another basketball training device involves the use of a barrier over which a basketball shot must be lofted in order to pass through the basketball goal. A device of this type comprises a semi-circular member having a radial dimension larger than the basketball goal with each end of the semi-circular member engaged with the basketball backboard. The plane including the semi-circular member is parallel to the plane including the basketball goal. The advantage of such a device is that it may be used by a shooter from any practice position on the basketball court without the need for repositioning the device each time the shooter wishes to change the position on the basketball court from which he or she is practicing. In addition, its proximate relationship to the basketball goal directs the shooter's attention toward the basketball goal as the shooter attempts the shot. The devices disclosed in U.S. Pat. No. 5,827,136 issued to Halter et al., and in U.S. Pat. No. 3,342,486 issued to Farley, each discloses a basketball training aid of this general type. While each device possesses advantages over the Ferrari device and the LoFaso, Sr. device, the devices disclosed by Halter et al. and by Farley still possess several disadvantages.

The Halter et al. device is a children's backboard and basketball goal assembly designed for mounting to a door. The semi-circular member of the Halter et al. device is pivotably attached to the backboard and basketball goal assembly in such a manner that it can be retracted into the backboard portion of the device. The retracted semi-circular member of the Halter et al. device leaves a non-uniform surface to the backboard, which is disadvantageous in that it may distort basketball shots banked therefrom. Further, the semi-circular member is built into the backboard, and thus is deployable to a single, pre-determined position relative to the hoop and thus cannot be adjusted. Thus, it is desired to provide a device which may be completely detached from the backboard, leaving a uniform surface to the backboard from which shots may be banked with predictable results.

To properly position its semi-circular member, the Farley device requires use of large clamps to attach the ends of the semi-circular member to each side of the basketball backboard, as well as supporting rods that are clamped to the basketball goal. Tools are required to attach and detach the rods. Thus, while the Farley device leaves a uniform surface to the basketball backboard when removed, the effort involved in attaching and removing the Farley device is substantial. The presence of the rods limits the degree, if any, to which the Farley device may be adjusted vertically relative the goal hoop, and virtually eliminate the possibility of horizontal adjustment. In addition, the supporting rods used by Farley have limited utility when used with the modern basketball goals incorporating breakaway rims.

For the foregoing reasons, it is desired to provide a basketball training aid that includes the use of a barrier over which a basketball shot must be lofted in order to pass through the basketball goal. The desired device will be easy to attach and to remove from the basketball backboard apparatus, and will not require support from the basketball goal for proper use. When removed, the desired device will leave a uniform surface to the backboard from which basketball shots may be banked with predictable results. The desired device also will be lightweight, economic to manufacture, reasonably priced, and constructed of reliable materials.

SUMMARY

The present invention is an improved basketball training aid comprising a barrier over which a basketball shot must be lofted in order to pass through the basketball goal. The basketball training aid is intended for attachment to a basketball backboard having a conventional basketball goal with a circular rim mounted to the front surface of the basketball backboard.

In one embodiment, the basketball training aid comprises a shield having a first end and a second end and being formed into a substantially semi-circular shape or a substantially semi-elliptical shape, with a first gripping means and a second gripping means affixed respectively to attachable to the front surface of the basketball backboard. The gripping means may be attached at any location on said front surface of said basketball backboard convenient to training shooting from a position defined by substantially any angle and distance relative to the goal. The gripping means may be toollessly released from said front surface of said basketball backboard.

In one embodiment, the gripping means comprise vacuum cups which attach by vacuum to the front surface of the backboard when compressed thereagainst. Such vacuum cups comprise means for releasing the vacuum, thus releasing the present invention from the front surface of the basketball backboard.

In one embodiment, the shield is held in place slightly above and substantially parallel to the basketball goal solely by the gripping means, with the substantially semi-circular shape or substantially semi-elliptical shape of the shield extending away from the front surface of the basketball backboard at least slightly farther than the circular rim of the basketball goal, thereby causing an upper surface of the shield to be positioned above a top surface of the circular rim and outside a front edge of the circular rim.

In one embodiment, the shield comprises a flexible strip of polycarbonate material, with a portion of the strip adjacent to each end bent at approximately 90° to the center segment of the strip to form legs. In another embodiment, the shield comprises an injection molded polycarbonate material molded into a predetermined curved shape, wherein a portion of the curved shape adjacent to each end is curved at approximately 90° to form legs.

The basketball training aid also may incorporate tethering means engaged with the gripping means to prevent the basketball training aid from falling to the ground if the gripping means unexpectedly disengage from the front surface of the backboard.

These and other features and advantages of the present invention, and the manner of attaining them, will be more apparent and better understood by reference to the following descriptions of embodiments of the invention taken in conjunction with the accompanying drawings and with the appended claims.

DETAILED DESCRIPTION OF THE PREFERRED EMBODIMENTS

The present invention is an improved basketball training aid comprising a barrier over which a basketball shot must be lofted in order to pass through the basketball goal. A basketball training aid according to the present invention is easy to attach and remove from the basketball backboard and goal apparatus, and does not require support from the basketball goal or from other supporting means or apparatus during use. A basketball training aid according to the present invention attaches to the surface of the basketball backboard for use. When the basketball training aid is removed, the basketball backboard is left with a substantially planar surface from which basketball shots may be banked with predictable results.

Figure 1:
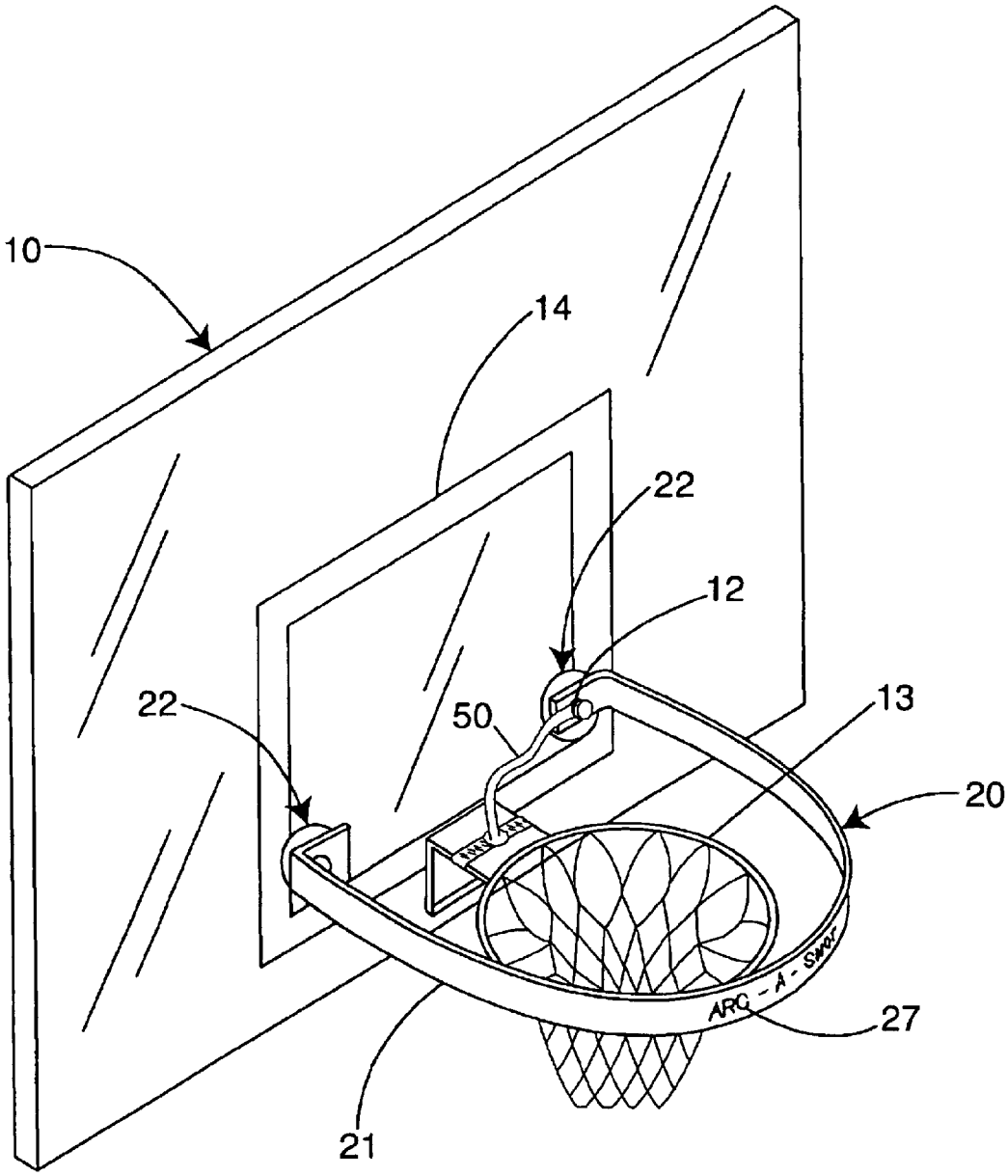
FIG. 1 shows a left upper front perspective view of one embodiment of an improved basketball training aid according to the present invention, as installed on a basketball backboard and goal apparatus.

FIG. 1 shows a left upper front perspective view of one embodiment of an improved basketball training aid 20 according to the present invention, as installed on a regulation sized basketball backboard and goal apparatus, such as that used in games sanctioned by the National Basketball Association.

Figure 2A:
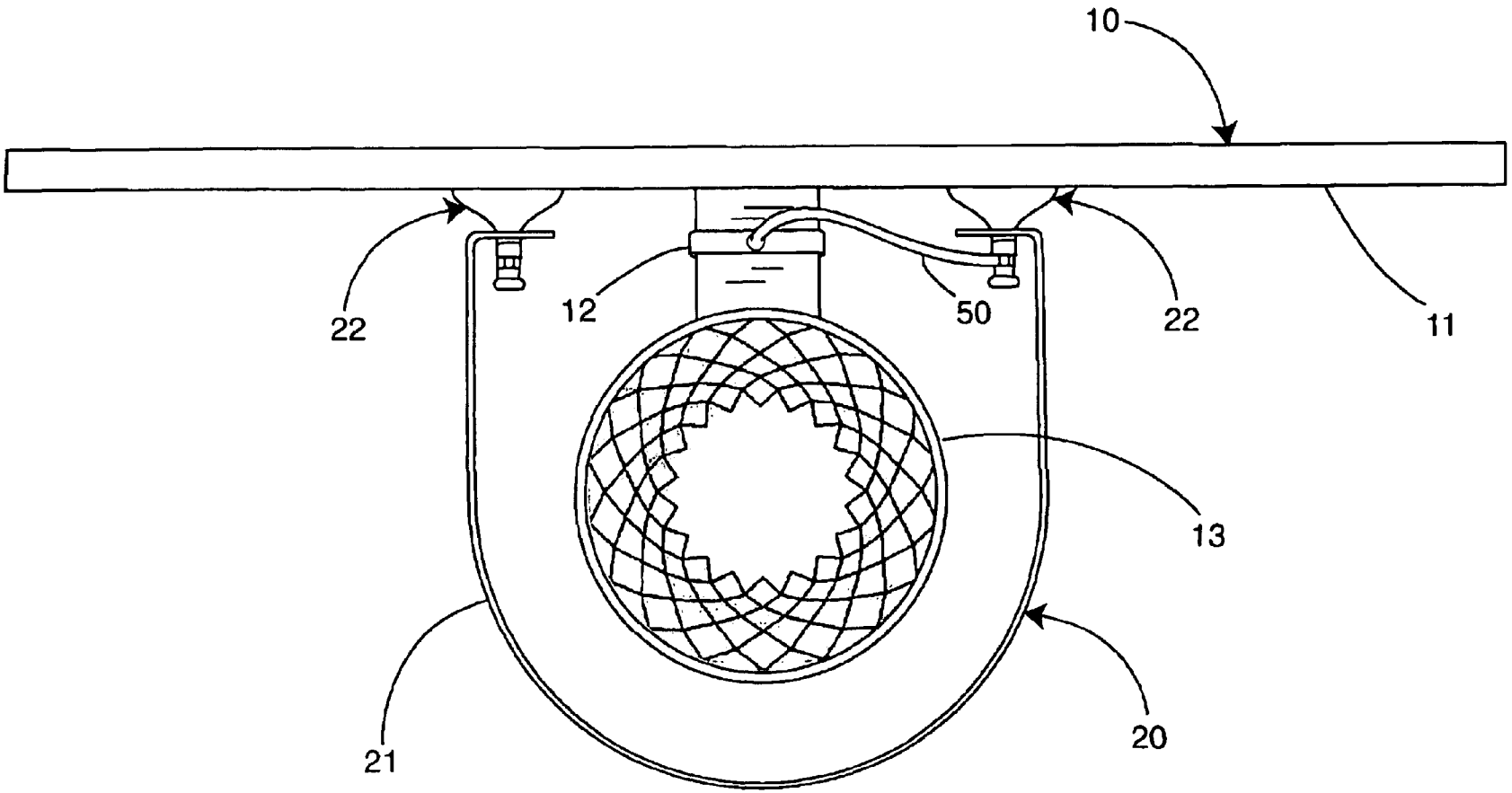
FIG. 2A shows a top view of the embodiment of the improved basketball training aid of FIG. 1.
Figure 2B:
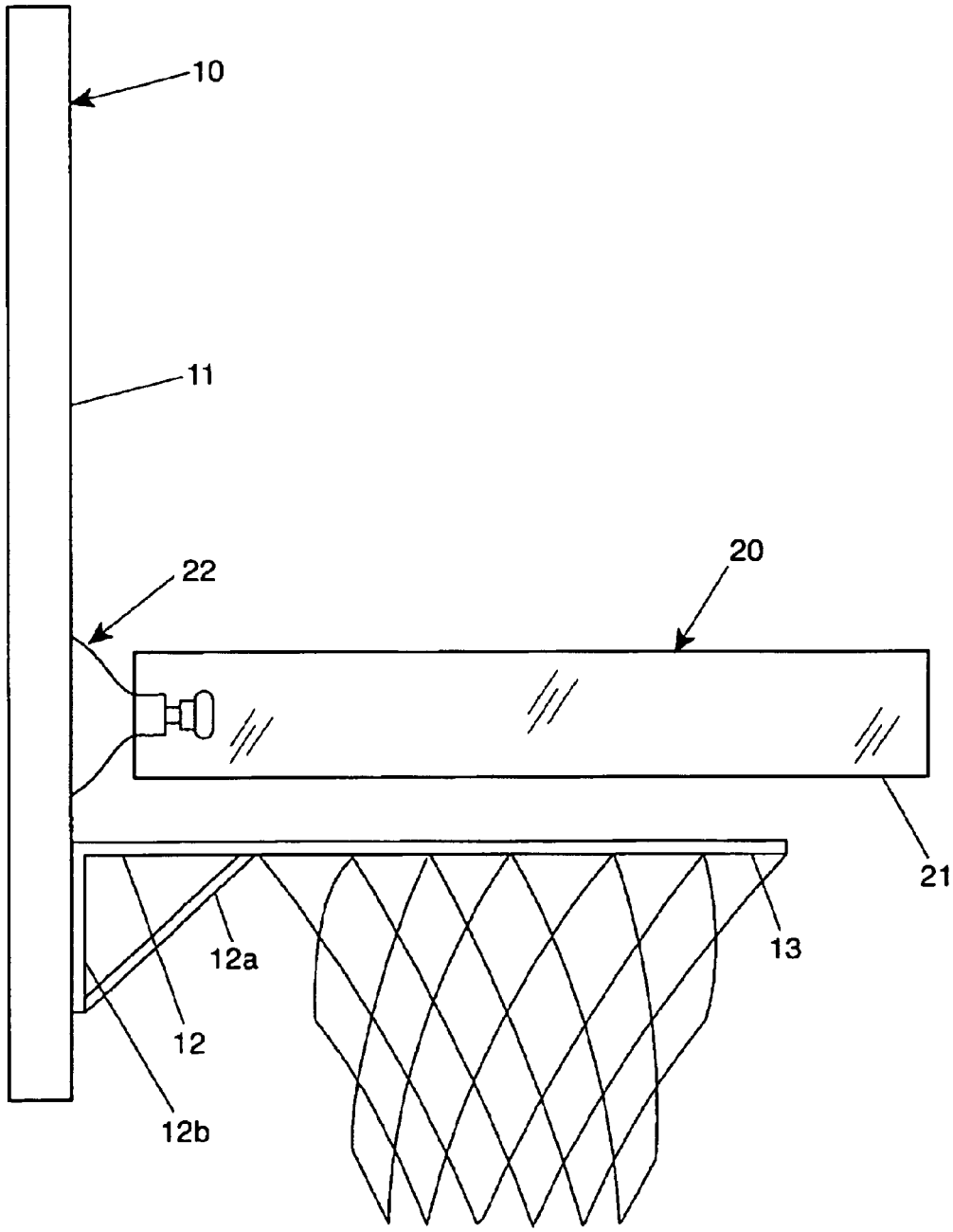
FIG. 2B shows a side view of the embodiment of the improved basketball training aid of FIG. 1.

FIG. 2A shows a top view of the basketball backboard and goal apparatus of FIG. 1, with basketball training aid 20 according to the present invention installed thereon. FIG. 2B shows a side view of the basketball backboard and goal apparatus of FIG. 1, with basketball training aid 20 according to the present invention installed thereon.

Shown in FIGS. 1, 2A, and 2B is basketball training aid 20, comprising shield 21 and a first and a second gripping means 22. Optionally, basketball training aid 20 also comprises logo 27. Also shown in FIGS. 1, 2A, and 2B is backboard 10 comprising a substantially planar vertical front surface 11, L-shaped basketball goal support 12 comprising a first arm 12*a* and a second arm 12*b*, and conventional basketball goal 13. Arm 12*a* of basketball goal support 12 has a conventional basketball goal 13 securely attached to the outer edge thereof, such as by welding. Optionally, basketball goal support 12 and basketball goal 13 may be of unitary construction. Arm 12*b* of basketball goal support 12 is positioned against front surface 11, near the lower edge of front surface 11 and equidistant from each vertical edge of front surface 11, and then attached to backboard 10 by means known in the art, such as by bolting. When so attached, basketball goal 13 is oriented horizontally and extends outwardly from front surface 11. Thus, basketball goal 13 is in a plane disposed substantially perpendicular to the plane of front surface 11.

In the embodiment of backboard 10 shown in FIG. 1, front surface 11 comprises a target rectangle 14, but this is not required. Optionally, a rectangle 14 comprising striping which may be painted, etched, embossed, or otherwise affixed to front surface 11 in low relief so that the presence of rectangle 14 does not substantially alter the planar nature of front surface 11 may be added to assist shooting accuracy for shots banked off front surface 11. The horizontal and vertical legs of rectangle 14 are substantially parallel to the horizontal and vertical edges of front surface 11, respectively. Each vertical leg of rectangle 14 is equidistant from the corresponding vertical edge of backboard 10. In the embodiment of backboard 10 shown in FIG. 1, the lower leg of rectangle 14 is disposed between and front surface 11 and arm 12*b* of basketball goal support 12.

Improved basketball training aid is installed on basketball backboard 10 by affixing each gripping means 22 to front surface 11. When attached to front surface 11, gripping means 22 collectively provide gripping force sufficient to hold shield 21 in place above and substantially parallel to basketball goal 13. Preferably, gripping means 22 are affixed so that an imaginary line drawn between the center of each gripping means 22 is substantially parallel to and above the horizontal plane of basketball goal 13. Thus, the horizontal plane of shield 21 will be substantially parallel to and above the horizontal plane of basketball goal 13. However, gripping means 22 may be easily and adjustably positioned on said basketball backboard so as to facilitate training from various shot angles and distances relative to the goal. Gripping means 22 are preferably toollessly releaseable. In other words, gripping means 22 may preferably be released from the front surface 11 without the aid of hand tools. In one implementation, gripping means 22 are positioned approximately twenty-four inches (24") apart on front surface 11, and slightly above goal 13 so that the bottommost edge of shield 21 is approximately two inches (2") from the topmost edge of basketball goal 13. The exact position may be varied upwardly or downwardly on front surface 11 depending on the desired trajectory of basketball shots aimed at the basketball goal during training. The distance between the gripping means 22 also may be varied to be more than or less than twenty-four inches (24") depending on the desired trajectory of basketball shots aimed at the basketball goal during training.

Optionally, a tethering means 50 may be engaged with each gripping means 22 and with basketball goal support 12. The optional tethering means 50 is used to reduce the likelihood that basketball training aid 20 will fall to the ground in the event that one or both gripping means 22 unexpectedly detaches from front surface 11. Basketball training aid 20 is removed from front surface 11 by detaching each gripping means 22 from front surface 11.

Figure 3:
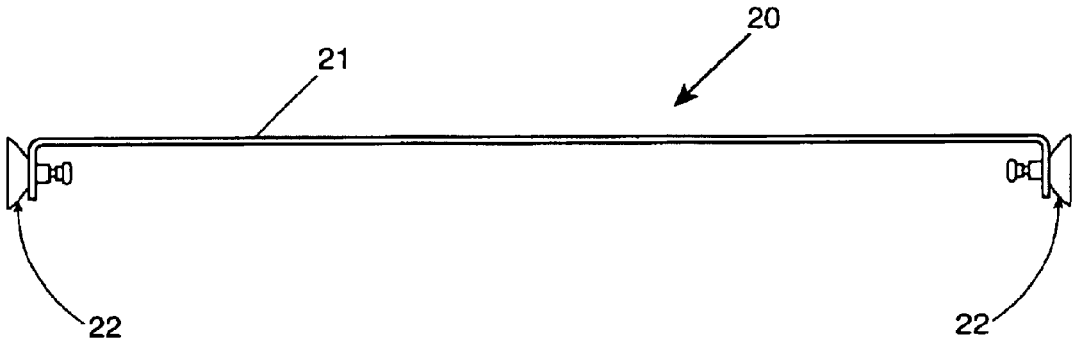
FIG. 3 shows a partial side view of one embodiment of a basketball training aid according to the present invention when disengaged from a basketball backboard and goal apparatus.

FIG. 3 shows a side view of one embodiment of a basketball training aid according to the present invention when disengaged from backboard 10. In the embodiment shown in FIG. 3, shield 21 comprises a substantially flat strip comprising a flexible polycarbonate material, such as a strip comprising the polycarbonate material sold by General Electric under the trade name LEXAN®. Other polycarbonate and non-polycarbonate materials may be used, as long as the material selected is flexible and lightweight enough to require support only by the gripping means attached thereto, yet also is durable enough to withstand the impact of misaimed basketball shots that may strike it during use. Where shield 21 comprises a polycarbonate material such as the General Electric LEXAN® material, it is preferable that the thickness of shield 21 be at least on eighth inch (⅛").

To fabricate the embodiment of basketball training aid 20 shown in FIG. 3, a practitioner begins with a flat strip of the desired polycarbonate material, wherein the strip has a length significantly greater than its width. Preferably, the strip of polycarbonate material comprising shield 21 is at least one inch (1") wide. In one implement of the present invention, the strip of polycarbonate material comprising shield 21 is approximately seventy-two inches (72") long and two inches (2") wide. Such precise measurements of length and width are not required, however. It is only required that length of shield 21 be sufficient so that when the basketball training aid 20 is attached to the front surface of backboard 10 as shown in FIGS. 1, 2A, and 2B, the distance between front surface 11 and the midpoint of shield 21 is at least slightly greater than the distance between front surface 11 and the point of basketball goal 13 most distant from front surface 11. Thus, the curvature of shield 21 when attached to front surface 11 is at least slightly greater than the curvature of basketball goal 13. Preferably, the curvature should be such that shield 21 extends between about one-half inch (½") and about four inches (4") outside the front edge of goal 13.

In some implementations, the strip of the polycarbonate material is cut from a larger sheet of polycarbonate material into one or more rectangular strips by means known in the art. If necessary, the edges of each strip are deburred and beveled to reduce the likelihood of injury to those handling the strip or the finished basketball training aid.

In the embodiment shown in FIG. 3, each end of shield 21 is adapted for attachment of gripping means 22. Each gripping means 22 shown in FIG. 3A comprises a vacuum cup assembly, such as that sold by All-Vac Industries, Inc. of Skokie, Ill., under the part number A1867. Other gripping means known in the art may be used, such as, for example, multiply ordinary suction cups, as long as the gripping means selected: (i) will affix the basketball training aid to the front surface of a basketball backboard without marring the basketball backboard; (ii) may be removed from the basketball backboard, without marring the basketball backboard; and (iii) when affixed to the basketball backboard, collectively provide gripping force sufficient to support shield 21, including during those times when shield 21 is struck by one or more misaimed basketball shots. In one embodiment, the gripping force of each gripping means is at least about seventy-five (75) pounds.

Where gripping means 22 comprises a vacuum cup assembly, an installation hole is made through shield 21 near each end thereof, such as by drilling. In one implementation of the present invention, the center of the hole is between about one and one-half inches (1-½") and about two inches (2") from each end of shield 21. The center of each such hole is located approximately in the center of the width of shield 21.

A portion of each end of shield 21 than is bent across the width of shield 21 to form an angle of approximately ninety degrees (90°) to form supporting legs 28. The bend is made in each end of shield 21 at a point beyond the location of the hole, so that each leg 28 including the hole is at an angle of approximately ninety degrees (90°) from the center segment of shield 21. The legs 28 are bent in a direction so that both extend in the same direction from shield 21 as shown in FIG. 3. The corner between each leg 28 and the center segment of shield 21 may comprise a smooth radius as long as the portion of each leg 28 including the hole is at an angle of approximately ninety degrees (90°) from the center segment of shield 21.

Those skilled in the art will recognize that a basketball training aid according to the present invention comprises a cantilever design supported during use only by the gripping means 22 on the basketball backboard. Because gripping means 22 may comprise flexible materials, the action of gravity on shield 21 as it extends away from the front surface of the basketball backboard may cause shield 21 to rotate slightly about a fulcrum comprising the gripping means 22. The midpoint of shield 21 may be displaced slightly downwardly, causing shield 21 to lose its substantial parallelism with the basketball goal.

Figure 4A:
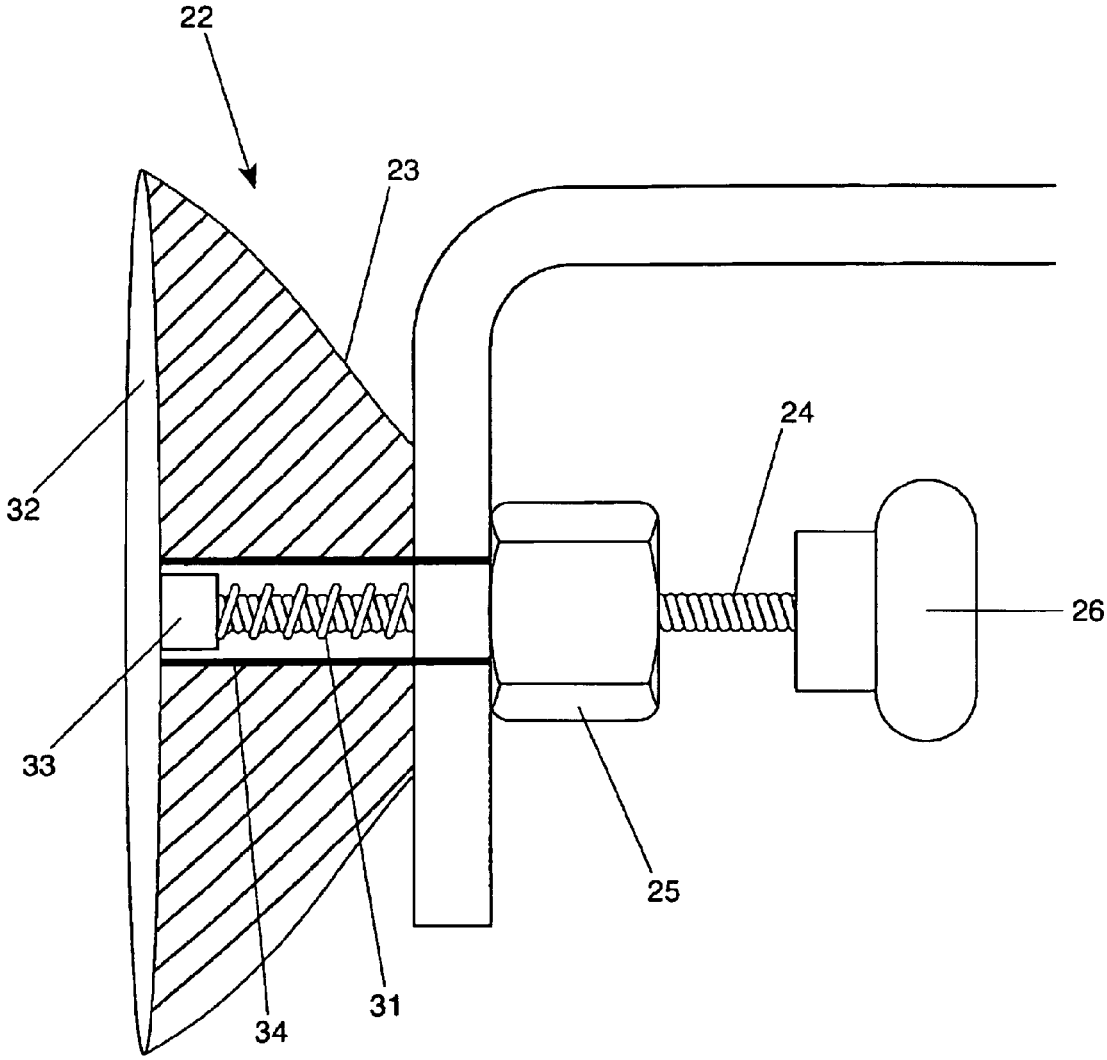
FIG. 4A shows a partially cut-away top view of a gripping means according to the present invention.
Figure 4B:
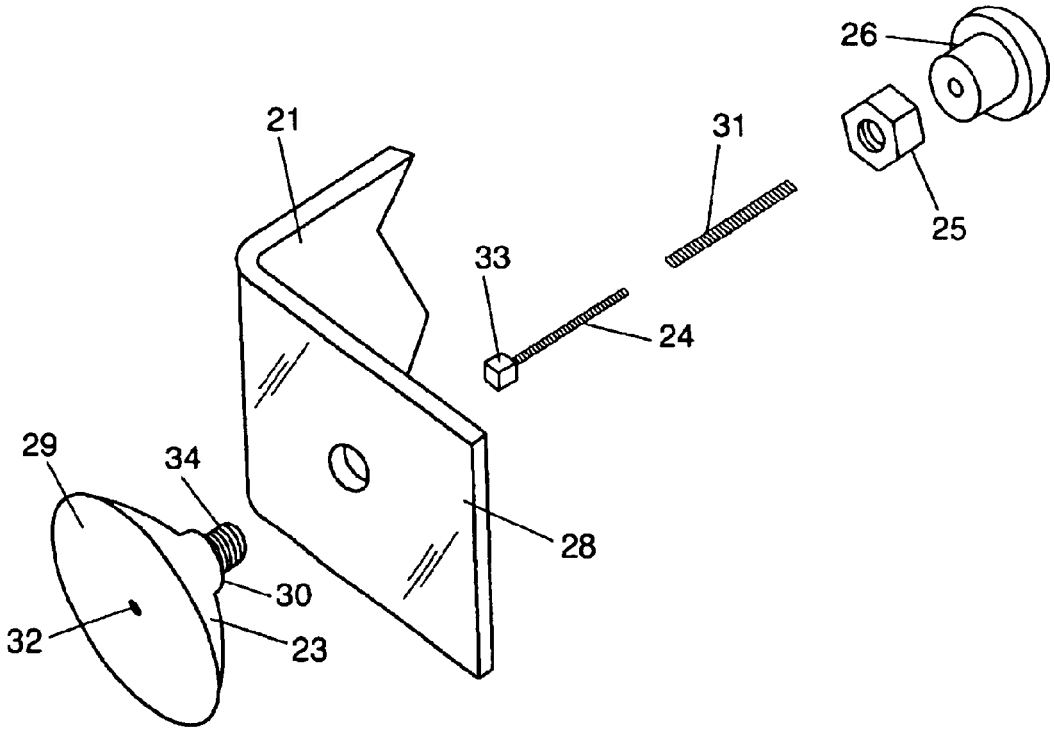
FIG. 4B shows an exploded perspective view of the gripping means of FIG. 4A.

As can be seen from FIGS. 3 and 4B, when disengaged from backboard 10 each leg 28 comprises an equal degree of canting which substantially offsets the gravitational action on shield 21 when the basketball training aid is affixed to backboard 10. In the absence of gravity, a cant in each leg 28 causes shield 21 to tilt upwardly as it extends away from backboard 10. Under normal gravitational conditions, the cant in each leg 28 substantially offsets the gravitational action on shield 21, causing shield 21 to be positioned substantially parallel to basketball goal 13 when each gripping means 22 is affixed to front surface 11 of backboard 10. At the discretion of the practitioner, the cant may be formed in each leg 28 at the same time each leg 28 is formed from sheild 21, or thereafter.

Those skilled in the art will recognize that the degree of canting required in a particular implementation of the present invention varies depending on many factors such as the weight of shield 21, the distance between the midpoint of shield 21 and the front surface of backboard 11, and the rigidity of gripping means 22. For example, a heavier shield 21 will require a greater degree of canting than a lighter shield 21. Likewise, the greater the distance between the midpoint of shield 21 and the front surface of backboard 11, the greater the degree of canting will be required. A more rigid gripping means 22 will require a lesser degree of canting than a less rigid gripping means 22. Other factors may be need to be taken into consideration by a practitioner in determining the appropriate canting required in a particular implementation of the present invention. In one implementation of the present invention wherein shield 21 comprises a polycarbonate material strip approximately seventy-two inches (72") long and two inches (2") wide and each gripping means 22 comprises a vacuum cup, canting of about nine degrees (9°) in each leg was sufficient to substantially offset the gravitational action on the shield and hold the shield in the desired position. Other implementations of the present invention may require a greater degree or lesser degree of canting in each leg.

Gripping means 22 are attached to each leg 28 of shield 21. Where the gripping means 22 comprises a vacuum cup assembly, attachment of each gripping means 22 is accomplished as shown in FIGS. 4A and 4B. FIG. 4A shows a partially cut-away top view of a gripping means 22 comprising a vacuum cup assembly mounted to one leg 28 of shield 21. FIG. 4B shows an exploded perspective view of the gripping means 22 of FIG. 4A, illustrating assembly of the vacuum cup assembly on leg 28.

In FIGS. 4A and 4B, gripping means 22 comprises suction cup 23, sealing rod 24, nut 25, knob 26, and spring 31. Suction cup 23 has a hollow interior with a flexible concave first end 29 engageable with a basketball backboard, and a flat second end 30. End 29 of suction cup 23 comprises central orifice communicating between end 29 and the hollow interior of suction cup 23.

Mounted to and lining the hollow interior of suction cup 23 is hollow sleeve 34, comprising a rigid tubular material internally sized to receive sealing rod 24 and sealing plug 33 (as described hereinafter). Sleeve 34 has a first end comprising a substantially closed end having a narrow central opening therethrough which aligns and communicates with the central orifice of end 29 of suction cup 23, and a second end which extends past second end 30 of suction cup 23 and comprises an externally threaded opening, externally sized to pass through the installation hole in leg 28. Together, the narrow central opening of the second end of sleeve 34 and the central orifice of end 29 of suction cup 23 comprise vacuum release hole 32.

Sealing rod 24 comprises a small-diameter threaded rod having a first end and a second end. The first end of sealing rod 24 comprises sealing plug 33 sized so that it passes through the second end of sleeve 34, but does not pass through vacuum release hole 32.

Spring 31 is cylindrical in shape, with a diameter slightly larger than sealing rod 24. Nut 25 comprises a nut having a first end threadably engageable with the second end of sleeve 34, and a second end engageable with the second end of sealing rod 24. Knob 26 comprises a knob for engagement with a human hand. Knob 26 comprises female threads engageable with the second end of sealing rod 24.

The vacuum cup assembly is installed by placing the second end of sleeve 34 through the installation hole in leg 28 of shield 21. The first end of sealing rod 24 then is inserted into the second end of sleeve 34 until it abuts the first end of sleeve 34. The second end of sealing rod 24 remains exposed outside the second end of sleeve 34. Spring 31 is slipped over sealing rod 24 until spring 31 abuts against sealing plug 33. The second end of sealing rod 24 then is passed through the second end of nut 25. The first end of nut 25 is threaded onto the second end of sleeve 34, and is tightened until end 30 of suction cup 23 is engaged against one side of leg 28, and nut 25 is engaged against the other side of leg 28. Proper engagement of nut 25 causes spring 31 to be compressed inside suction cup 23, thereby causing sealing plug 33 to be forced against vacuum release hole 32, preventing the passage of air through vacuum release hole 32. Knob 26 then is engaged with the exposed second end of sealing rod 24. The process is repeated for each gripping means 22.

In use, end 29 of suction cup 23 is compressed against front surface 11 of backboard 10, causing a vacuum to be formed between end 29 and front surface 11. The vacuum is released by pulling knob 26 in a direction away from front surface 11, thus causing sealing plug 33 to lose engagement with vacuum release hole 32, permitting the passage of air through vacuum release hole 32.

A portion of suction cup 23 is cut away in FIG. 4A to show the relationship of sealing rod 24, spring 31, vacuum release hole 32, sealing plug 33, and sleeve 34 inside the hollow interior of suction cup 23. In addition, to illustrate this embodiment of gripping means 22, a small length of sealing rod 24 is shown in FIG. 4A as being exposed between knob 26 and the second end of nut 25. Exposure of sealing rod 24 in this manner is not required. Sealing rod 24 may be engaged with nut 25 and knob 26 such that sealing rod 24 is completely obscured, with knob 26 thus being positioned against the second end of nut 25.

Figure 5:
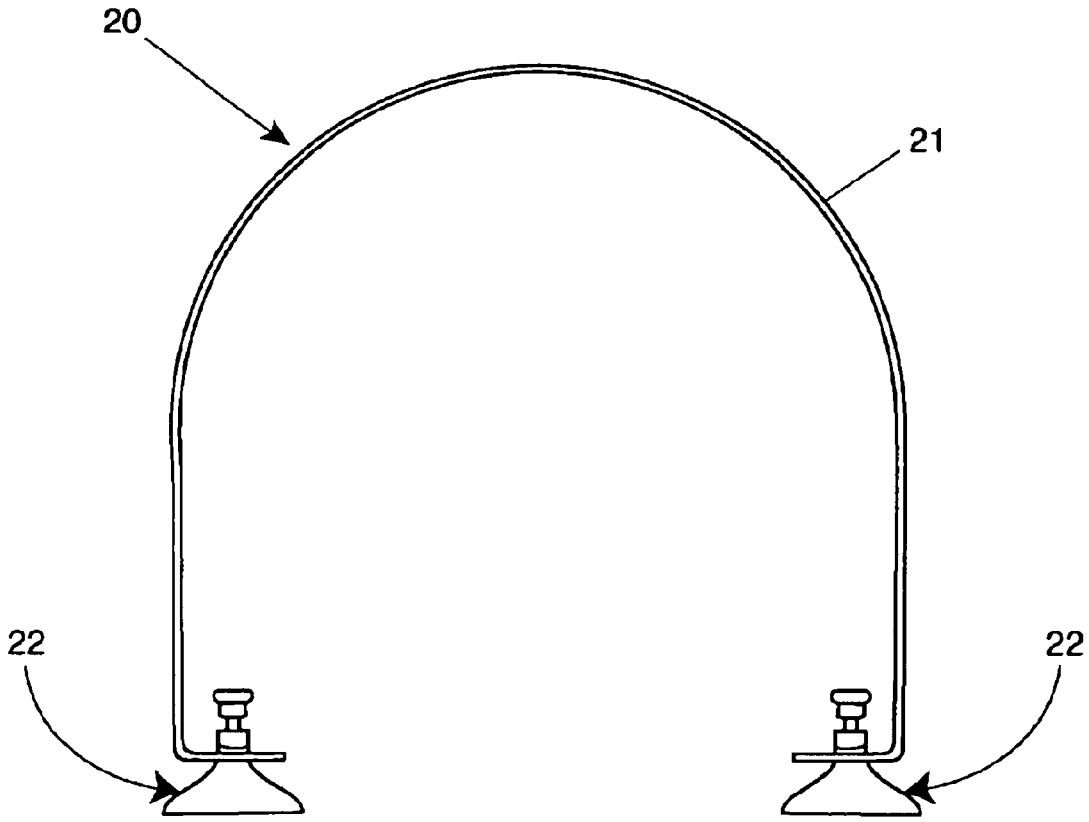
FIG. 5 shows a top view of one embodiment of a basketball training aid according to the present invention when disengaged from a basketball backboard and goal apparatus.

A top view of an alternate embodiment of improved basketball training aid 20 according to the present invention is shown in FIG. 5 disengaged from a basketball backboard. In the embodiment shown in FIG. 5, shield 21 comprises a polycarbonate material, such as the polycarbonate material sold by General Electric under the trade name LEXAN®, which is formed into a shield of the desired shape and size by injection molding. Other polycarbonate materials may be used, as long as the material selected is injection moldable into a shield lightweight enough to require support only by the gripping means disclosed herein, and durable and flexible enough to withstand the impact of misaimed basketball shots which may strike it during use.

The embodiment shown in FIG. 5 is made by providing a mold of a type known in the art to be suitable for the chosen polycarbonate material, and having internal dimensions substantially the same as the external dimensions of the finished shield. The chosen polycarbonate material is injected into the mold using techniques well known in the art and permitted to cure into the shape of shield 21. The cured shield 21 then is removed from the mold. Supplemental processing may be performed on shield 21 to produce the desired dimensions and surface finish. After the desired dimensions and surface finish are achieved, gripping means 22 are installed.

The present invention is an improved basketball training aid providing significant advantages over the prior art. The basketball training aid according to the present invention attaches to the surface of the basketball backboard for use, and, when removed therefrom, leaves the front surface to the basketball backboard substantially planar so that basketball shots may be banked with predictable results. A basketball training aid according to the present invention is lightweight, economic to manufacture, reasonably priced, and constructed of reliable materials.

The use of a basketball training aid according to the present invention is illustrated herein in conjunction with a regulation-sized basketball baskboard and goal apparatus, such as that used in games sanctioned by the National Basketball Association. As will be appreciated by those skilled in the art, a basketball training aid according to the present invention may be adapted for use with other types of basketball backboards, such as, for example, curved or fan-shaped backboards or rectangular backboards of non-regulation dimensions. In addition, those skilled in the art will recognize that a basketball training aid according to the present invention may be adapted for use with a basketball backboard comprising one of many materials, such as, for example, glass, polycarbonate materials, fiberglass, wood, plywood, particle board, or other materials well-known in the basketball backboard construction art. Accordingly, it is within the scope of the present invention that if the basketball backboard comprises a material such as wood or a wood product through which small holes may be made without substantially distorting the front surface of the backboard, the basketball training aid of the present invention may comprise gripping means such as bolts which engage through such small holes and hold the shield in the desired position against the front surface of the backboard.

In addition, the dimensions of the shield and the placement of the basketball training aid on the basketball backboard discussed herein do not show every possible embodiment of the present invention. The length and/or width and/or placement of the basketball training aid on the basketball backboard may be altered and still fall within the scope of the present invention. For example, a practitioner may find it desirable to construct a basketball training aid according to the present invention in which the shield is longer and/or wider than the embodiment discussed herein, although the width of the shield preferably is less than about eight inches (8"). To compensate for changes in the length and/or width, such an embodiment of the present invention may need to be placed higher on the basketball backboard, thus permitting such an embodiment to serve its intended function of promoting an improved trajectory to a basketball shot. Likewise, the shield is discussed herein in terms of a shield comprising a rectangular cross-section. In fact, the shield may comprise a cross-section that is square, circular, elliptical, or another shape known in planar geometry, and still fall within the scope of the present invention.

Thus, while this invention has been described as having a preferred design, the present invention can be further modified within the scope and spirit of this disclosure. This application is therefore intended to cover any variations, uses, or adaptations of the invention using its general principals. Further, this application is intended to cover such departures from the present disclosures as come within known or primary practices in the art to which this invention pertains and which fall within the limits of the appended claims.

I claim:

1. A basketball shooting training aid for use with a basketball backboard having a substantially planar front surface and a conventional basketball goal having a circular rim mounted to said front surface of said basketball backboard, the basketball training aid comprising:

a shield having a first end and a second end and being formed into a substantially semi-elliptical shape; and a first gripping means and a second gripping means affixed respectively to said first end and said second end of said shield, each of said gripping means being releasebly attachable to said front surface of said basketball backboard so that said shield is held in place slightly above and substantially parallel to said basketball goal by said gripping means, with said semi-elliptical shape of said shield extending away from said front surface of said basketball goal, thereby causing an upper surface of said shield to be positioned above a top surface of said circular rim and outside a front edge of said circular rim;

wherein the gripping means may be attached at any location on said front surface of said basketball backboard convenient to training shooting from a position defined by substantially any angle and distance relative to the goal;

wherein the gripping means may be toollessly released from said front surface of said basketball backboard; and tethering means engaged with said gripping means to prevent said basketball training aid from falling to the ground if said gripping means disengage from said front surface of said backboard.

2. The basketball training aid of claim 1, wherein said shield comprises a flexible strip of polyrcabonate material.

3. The basketball training aid of claim 2, wherein said strip of polycarbonate material has a first end and a second end, and a portion of said strip adjacent to each respective end is bent at approximately 90° to said strip to form a first leg and a second leg.

4. The basketball training aid of claim 3, wherein each of said first leg and said second leg is canted to the extent necessary to position said shield substantially parallel to said basketball goal.

5. The basketball training aid of claim 1, wherein said shield comprises an injection molded polycarbonate material molded into a predetermined curved shape.

6. The basketball training aid of claim 5, wherein said injection molded shield has a first end and a second end, and a portion of said shield adjacent to each respective end is curved at approximately 90° to form a first leg and a second leg.

7. The basketball training aid of claim 6, wherein each of said first leg and said second leg is canted to the extent necessary to position said shield substantially parallel to said basketball goal.

8. The basketball training aid of claim 1, wherein each gripping means comprises a suction cup.

9. The basketball training aid of claim 1, wherein said shield is positioned so that said upper surface thereof is between about 1" and about 4" above said top surface of said rim, and between about ½" and about 4" outside said front edge of said rim.

10. The basketball training aid of claim 3, wherein said first gripping means and said second gripping means are affixed respectively to said first leg and said second leg, and each said gripping means comprises a vacuum cup comprising:

a concave flexible suction cup having a first surface formed so that it is compressible onto said front surface of said basketball backboard, and a second flat surface, said suction cup having a hollow interior portion that communicates on one side through an access opening through the second surface and communicates on another side to the concave first surface through a central vacuum release hole;

a rod having a first end and a second end extending through said access opening into said hollow interior portion;

a sealing plug adapted to seal said vacuum release hole when biased against said vacuum release hole, said sealing plug being engaged on said first end of said rod;

spring bias means normally biasing said sealing plug against said vacuum release hole within said hollow interior portion so that air can pass through said hole as said first surface as pressed against said front surface but seals against said vacuum release hole to cause a vacuum between said first surface and said backboard when pressing ceases, causing said suction cup to grasp the backboard; and a knob attached to said second end of said rod, said knob graspable to move said rod and said sealing plug against the biasing of said spring bias means to release said vacuum so that said suction cup can be removed from said front surface.

11. The basketball training aid of claim 10, wherein said vacuum cup further comprises a hollow sleeve mounted to an interior surface of said hollow interior, said hollow sleeve having a threaded portion extending outwardly from said second flat surface, and wherein said hollow sleeve is dimensioned to receive said rod within said hollow sleeve; and a threaded nut adapted to engage the threads of said threaded portion so that said sleeve can be mounted said first end and said second end of said shield.

12. The basketball training aid of claim 11, wherein each of said first leg and said second leg is canted to the extent necessary to position said shield substantially parallel to said basketball goal.

13. The basketball training aid of claim 12, wherein said shield is positioned so that said upper surface thereof is between about 1" and about 4" above said top surface of said rim, and between about ½ and about 4" outside said front edge of said rim.

14. A basketball training aid for use with a basketball backboard having a substantially planar front surface and a conventional basketball goal having a circular rim mounted to said front surface of said basketball backboard, the basketball training aid comprising:

a shield having a first end and a second end and being formed into a substantially semi-elliptical shape;

a first gripping means and a second gripping means affixed respectively to said first end and said second end of said shield, each of said gripping means being releaseably attachable to said front surface of said basketball backboard so that said shield is held in place slightly above and substantially parallel to said basketball goal solely by said gripping means, with said semi-elliptical shape of said shield extending away from said front surface of said basketball backboard at least slightly farther than said circular rim of said basketball goal, thereby causing an upper surface of said shield to be positioned above a top surface of said circular rim and outside a front edge of said circular rim; and a tether extending between the basketball backboard and the basketball training aid.

* * * * *